US006792833B2

(12) United States Patent
Macor

(10) Patent No.: US 6,792,833 B2
(45) Date of Patent: Sep. 21, 2004

(54) DOUBLE-ENDED WRENCH WITH ERGONOMIC HANDLE PORTIONS

(75) Inventor: Richard J. Macor, Hunterdon County, NJ (US)

(73) Assignee: Proprietary Technologies, Inc.

( * ) Notice: Subject to any disclaimer, the term of this patent is extended or adjusted under 35 U.S.C. 154(b) by 61 days.

(21) Appl. No.: 10/241,100

(22) Filed: Sep. 11, 2002

(65) Prior Publication Data

US 2004/0035261 A1 Feb. 26, 2004

Related U.S. Application Data

(63) Continuation-in-part of application No. 10/226,055, filed on Aug. 22, 2002, now Pat. No. 6,655,239.

(51) Int. Cl.[7] ..... B25B 13/02
(52) U.S. Cl. ..... 81/125.1; 81/124.3; 81/177.1
(58) Field of Search ..... 81/125.1, 124.3, 81/177.1, 124.4

(56) References Cited

U.S. PATENT DOCUMENTS 1,793,714 A * 2/1931 Newberg ..... 81/125.1
4,084,456 A * 4/1978 Pasbrig ..... 81/125.1
5,172,614 A 12/1992 Monnet
5,492,040 A * 2/1996 Bellas ..... 81/125.1
D434,292 S 11/2000 Hsieh

OTHER PUBLICATIONS

Kabo Tool Company "Twister" Wrench (Brochure for 2002).

* cited by examiner

*Primary Examiner*—Debra S. Meislin

(57) ABSTRACT

A double-ended wrench is described comprising a first wrench head connected to one end of a nondetachable elongated handle and a second wrench head connected to the other end thereof. Each wrench head has an orifice formed for engagement with various fasteners, and each orifice has an imaginary central axis of wrench rotation. The first wrench head is positioned relative to the second wrench head whereas the axis of wrench rotation of the first wrench head is substantially perpendicular to the axis of wrench rotation of the second wrench head. The nondetachable elongated handle is formed comprising a first handle portion connecting to the first wrench head, and a second handle portion connecting to the second wrench head, and a third handle portion located between the first and second handle portions. Each handle portion has a location at which there is a defined cross-sectional thickness when the wrench is viewed from an end view thereof, and, the third handle portion has a cross-sectional thickness substantially greater than a cross-sectional thickness of each of the first and second handle portions.

26 Claims, 3 Drawing Sheets

DOUBLE-ENDED WRENCH WITH ERGONOMIC HANDLE PORTIONS

REFERENCES TO RELATED APPLICATIONS

This application relates to, and is a continuation-in-part of copending U.S. patent application Ser. No. 10/226,055, filed on Aug. 22, 2002 now U.S. Pat. No. 6,655,239 entitled Double-ended wrench with ergonomic handle, also filed by the inventor herein.

FIELD OF THE INVENTION

The present invention relates to hand tools, particularly hand operated double-ended wrenches including combination wrenches, box wrenches, open end wrenches, flex head wrenches and the like.

BACKGROUND OF THE INVENTION

Hand operated double-ended wrenches have been around for many years and they are typically structured having an elongated, flat shaped handle with a wrench head at each end for turning various fasteners. Typical variations include combination, double box, double open-end, flex-head type and the like. The flat shaped handle connected to each wrench head provides each wrench head with excellent accessibility to fasteners. It is, however, the flat shaped handle that creates a major disadvantage associated with this tool. The elongated, flat handle provides only a thin surface area for the application of force by a user to turn and operate the wrench. This minimal surface area creates user discomfort and fatigue, while limiting torque and continuous-use capabilities.

More recently, there have been attempts to improve the double-ended wrench by forming a wrench with a twisted handle. The twisted handle configuration does provide some advantages including a greater surface area for the application of force by a user at each end of the wrench. However, the twisted handle of this type of wrench creates new problems including a reduction in strength, torque capacity, and accessibility to fasteners under some conditions. In addition, the distorted shape of the wrench handle may feel awkward and appear damaged or bent to a user.

Accordingly, there is a significant need to improve upon the typical prior art, double-ended wrenches. An improved double-ended wrench is contemplated which will provide a user with additional control, comfort and torque capabilities while reducing fatigue and tool related injuries, and further, without sacrificing wrench strength or accessibility to fasteners

SUMMARY OF THE INVENTION

The present invention involves a double-ended wrench comprising a first wrench head connected to one end of an nondetachable elongated handle and a second wrench head connected to the other end thereof. Each wrench head has an orifice formed for engagement with various fasteners, and each orifice has an imaginary central axis of wrench rotation. The first wrench head is positioned relative to the second wrench head whereas the axis of wrench rotation of the first wrench head is substantially perpendicular to the axis of wrench rotation of the second wrench head. The nondetachable elongated handle is formed comprising a first handle portion connecting to the first wrench head, and a second handle portion connecting to the second wrench head, and a third handle portion located between the first and second handle portions. Each handle portion has a location at which there is a defined cross-sectional thickness when the wrench is viewed from an end view thereof, and, the third handle portion has a cross-sectional thickness substantially greater than a cross-sectional thickness of each of the first and second handle portions.

Applicant recognizes the need for an improved double-ended wrench, and does accordingly consider the following objectives.

It is an important objective of the present invention described above, that it have two wrench heads.

It is another important objective of the present invention described above, that it be structured for excellent accessibility to fasteners.

It is another important objective of the present invention described above, that it be structured to provide additional user control, comfort and torque capabilities, while reducing user fatigue and possible tool related injuries.

It is another important objective of the present invention described above, that it be structured for strength and durability.

It is another important objective of the present invention described above, that it be readily acceptable by professional users.

And, it is yet another important objective of the present invention described above, that it be cost efficient to manufacture and commercially viable.

DETAILED DESCRIPTION OF THE DRAWINGS

Figure 1:
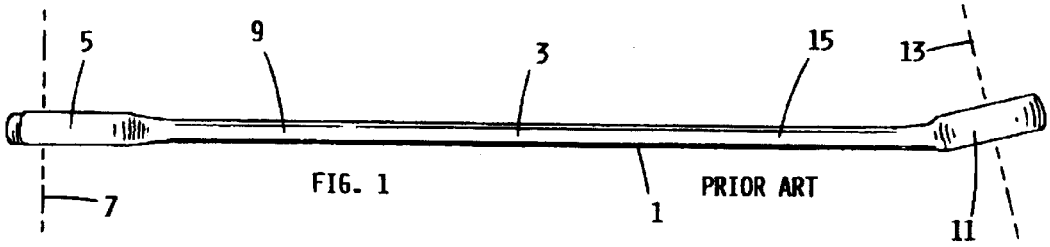
FIG. 1 PRIOR ART
FIG. 1 shows a left side, elevational view of a typical prior art double-ended wrench; and, FIG. 2 shows a top plan view of the prior art wrench shown in FIG. 1; and, FIG. 3 shows a left side, elevational view of a present invention double-ended wrench; and, FIG. 4 shows a top plan view of the present invention wrench shown in FIG. 3; and, FIG. 5 shows an end view of the present invention wrench shown in FIG. 4; and, FIG. 6 shows a cross-sectional, end view of the first handle portion of the present invention wrench shown in FIG. 3; and, FIG. 7 shows a cross-sectional, end view of the second handle portion of the present invention wrench shown in FIG. 3; and, FIG. 8 shows a cross-sectional, end view of the third handle portion of the present invention wrench shown in FIG. 3; and, FIG. 9 shows a perspective view of another present invention double-ended wrench; and, FIG. 10 shows a left side, elevational view of another present invention double-ended wrench; and, FIG. 11 shows a top plan view of the present invention wrench shown in FIG. 10.

Referring now to the drawings which are for the purpose of illustrating preferred embodiments of the present invention and not for the purpose of limiting same, FIG. 1 shows a left side, elevational view of a typical prior art double-ended wrench. Prior art wrench 1 has an elongated wrench handle 3 and a two wrench heads 5 and 11. Open end wrench head 5 has an imaginary central axis 7 which is the axis of wrench rotation for wrench head 5, and, wrench head 11 has an imaginary central axis 13 which is the axis of wrench rotation for wrench head 11. Wrench head 5 is connected to handle portion 9, and, wrench head 11 is connected to handle portion 15. When operating wrench 1, a user will generally grip handle portion 15 to turn wrench head 5 about imaginary central axis 7 to turn various fasteners. Alternatively, a user will generally grip handle portion 9 to turn wrench head 11 about imaginary central axis 13 to turn various fasteners. Wrench handle portion 9 is relatively thin as seen in this side view so that wrench head 5 can easily access and engage a fastener located in common or limited-access environments. Likewise, wrench handle portion 15 is relatively thin as seen in this side view so that wrench head 13 can easily access and engage with fasteners located in common and limited-access environments. Consequently, wrench handle portion 9 provides only a minimal surface area for the application of force by a user to turn and operate wrench head 11, and, handle portion 15 provides only a minimal surface area for the application of force by a user to turn and operate wrench head 5. This minimal surface area creates user discomfort and fatigue, while limiting control, torque and continuous-use capabilities.

Figure 2:
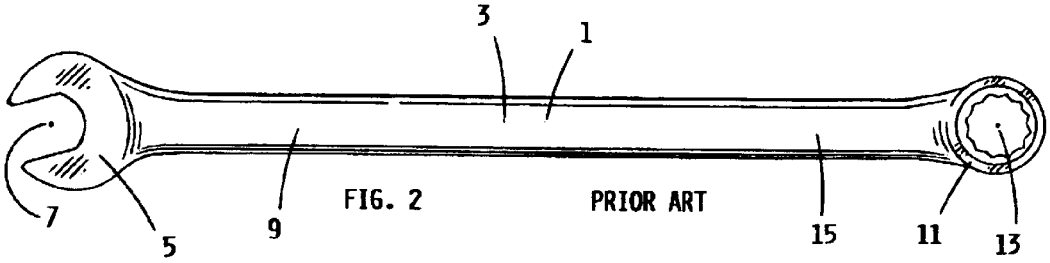
FIG. 2 PRIOR ART

FIG. 2 shows a top plan view of the prior art wrench shown in FIG. 1 with all visible components having the same reference numbers.

Referring now to both FIGS. 1 and 2 together, if wrench 1 were to be viewed from an end view (not shown), it is easy to comprehend that the imaginary central axis 7 of wrench head 5 would be substantially parallel to the imaginary central axis 13 of wrench head 11. In addition, it is easy to comprehend that the first and second handle portions 9 and 15 respectively, each have an elongated cross-sectional shape with the elongated cross-sectional shape of the first handle portion 9 being positioned substantially perpendicular to the axis of wrench rotation 7 of the first wrench head 5 and also the axis of wrench rotation 13 of the second wrench head 11. Similarly, the elongated cross-sectional shape of the second handle portion 15 is positioned substantially perpendicular to the axis of wrench rotation 13 of the second wrench head 11 and also the axis of wrench rotation 7 of the first wrench head 5. Also, the elongated handle 3 of Prior Art wrench 1 seen in FIGS. 1 and 2, is relatively unchanged structurally between wrench head 5 and wrench head 11. Accordingly, the defined thickness of elongated handle 3 is substantially constant and unchanging at different locations from one end to the other between wrench heads 5 and 11. Likewise, the defined cross-sectional area of the elongated handle 3 is substantially constant and unchanging at different locations between wrench heads 5 and 11. The structure of this typical prior art wrench provides excellent accessibility to fasteners, but only a minimal surface area for the application of force by a user to turn and operate the wrench, thus creating user discomfort and fatigue, while limiting control, torque and continuous-use capabilities. Accordingly, there is a significant need for an improved double-ended wrench, one which provides a user with additional control, comfort and torque capabilities while reducing fatigue and tool related injuries, without sacrificing wrench strength or accessibility to fasteners.

Applicant defines "cross-sectional" herein as relating to a cut section of a handle portion with the cut being substantially perpendicular to an imaginary longitudinal axis. Applicant defines "thickness" herein, as being the smallest dimension measurable across and through the center of a cut section of a handle portion. And, applicant defines "area" herein, as the measure, in square units, of a surface, for example, the cut section of a handle portion.

Figure 3:
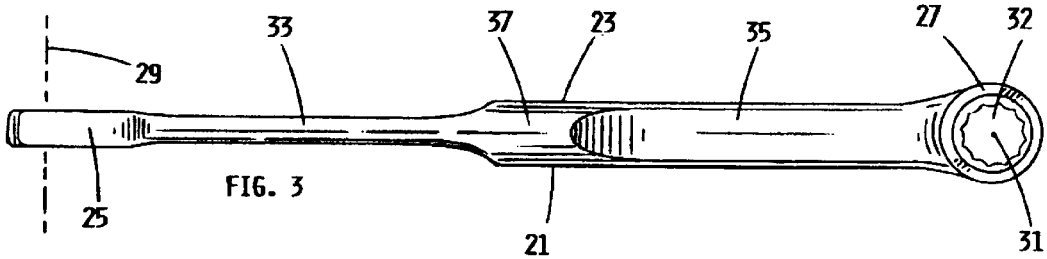
Figure 4:
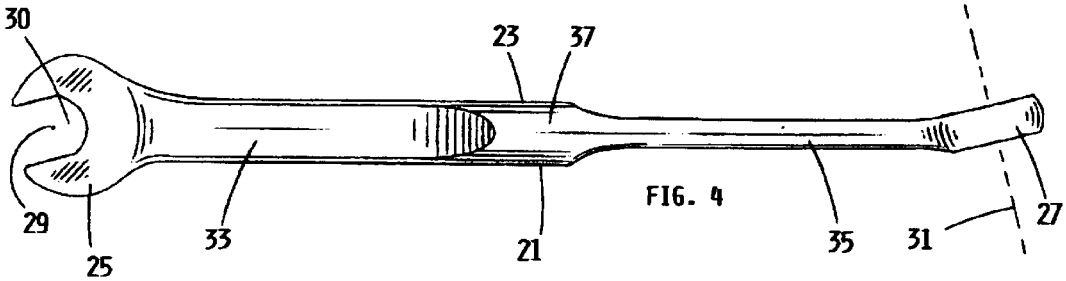

Referring to FIGS. 3 and 4 together, there is shown a present invention double-ended wrench shown in a left side elevational view and a top plan view respectively. Double-ended wrench 21 is shown comprising a first wrench head 25 connected to one end of an elongated handle 23 and a second wrench head 27 connected to the other end thereof. Wrench head 25 has an orifice 30, and wrench head 27 has orifice 32. Each orifice is formed for engagement with various fasteners. Orifice 30 has an imaginary central axis of wrench rotation 29, and orifice 32 has an imaginary central axis of wrench rotation 31. The first wrench head 25 is positioned relative to the second wrench head 27 whereas the axis of wrench rotation 29 of the first wrench head 25 is substantially perpendicular to the axis of wrench rotation 31 of the second wrench head 27 (seen best in FIG. 5). The elongated handle 3 is formed comprising a first handle portion 33 connecting to the first wrench head 25, and a second handle portion 35 connecting to the second wrench head 27, and a third handle portion 37 located between the first and second handle portions. The wrench heads 25 and 27 are each fixedly connected to wrench 21. Preferred embodiments of the present invention may have one or both wrench heads fixedly connected to the elongated handle of the wrench. Other embodiments may have one or both wrench heads pivotably connected to the elongated handle of the wrench to enhance wrench-to-fastener accessibility. When operating wrench 21, a user will generally grip handle portion 35 to turn wrench head 25 about imaginary central axis 29 to turn various fasteners. It can be seen in FIG. 3, that handle portion 35 provides a surface area substantially greater than that of the prior art wrench shown in FIG. 1, for the application of force by a user to turn wrench head 25 about axis of wrench rotation 29. Alternatively, a user will generally grip handle portion 33 to turn wrench head 27 about imaginary central axis 31 to turn various fasteners. It can be seen in FIG. 4, that handle portion 33 provides a surface area substantially greater than that of prior art wrench shown in FIG. 1, for the application of force by a user to turn wrench head 27 about axis of wrench rotation 31.

Figure 5:
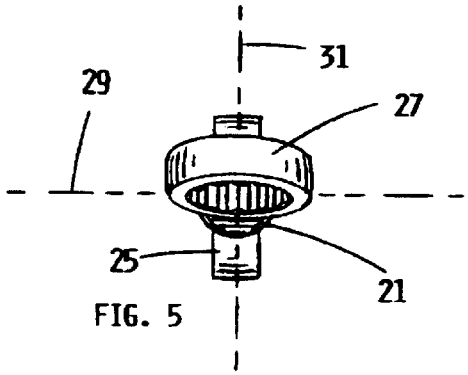

In FIG. 5, there is shown an end view of the present invention wrench shown in FIG. 4. In this view, it is easy to see and comprehend that the first wrench head 25 is positioned relative to the second wrench head 27 whereas the axis of wrench rotation 29 of the first wrench head 25 is substantially perpendicular to the axis of wrench rotation 31 of wrench head 27.

Figure 6:
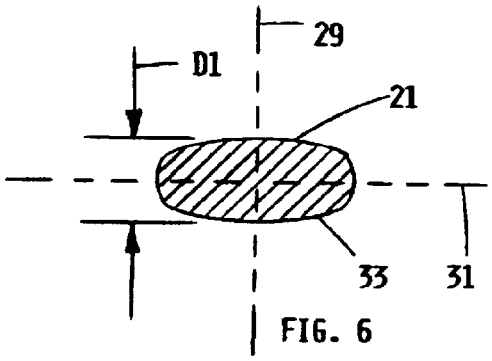

In FIG. 6, there is shown a cross-sectional, end view of the first handle portion 33 of wrench 21 shown in FIG. 3. It can be seen in this end view that first handle portion 33 has an elongated cross-sectional shape, and the elongated cross-sectional shape is elongated in a direction substantially perpendicular to the axis of wrench rotation 29 of the first wrench head and substantially parallel to the axis of wrench rotation 31 of the second wrench head. The cross-sectional shape of the first handle portion 33 is elongated in a distinct direction as shown, and therefore, the direction of elongation may be used to compare the orientation of the first handle portion to another handle portion or to an axis of wrench rotation. First handle portion 33 also has a defined cross-sectional thickness D1 shown at this cross-sectional cut view.

Figure 7:
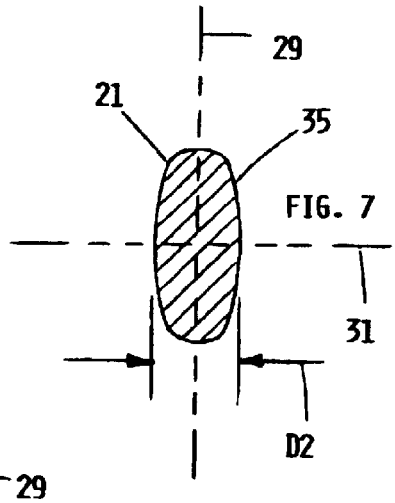

In FIG. 7, there is shown a cross-sectional, end view of the second handle portion 35 of wrench 21 shown in FIG. 3. It can be seen in this end view that second handle portion 35 has an elongated cross-sectional shape, and the elongated cross-sectional shape is elongated in a direction substantially perpendicular to the axis of wrench rotation 31 of the second wrench head and substantially parallel to the axis of wrench rotation 29 of the first wrench head. The cross-sectional shape of the second handle portion 35 is elongated in a distinct direction as shown, and therefore, the direction of elongation may be used to compare the orientation of the second handle portion to another handle portion or to an axis of wrench rotation. Second handle portion 35 also has a defined cross-sectional thickness D2 shown at this cross-sectional cut view.

Figure 8:
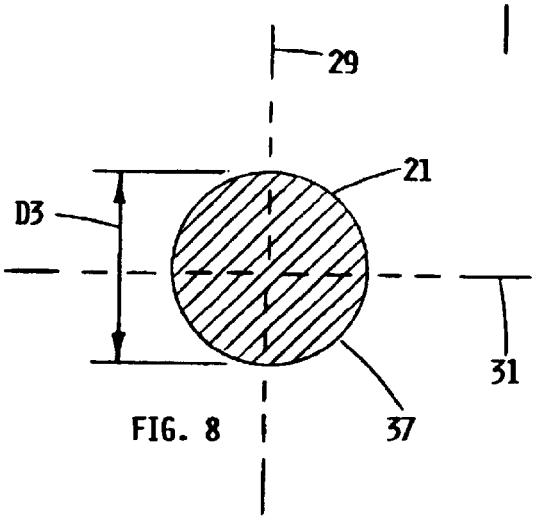

In FIG. 8, there is shown a cross-sectional, end view of the third handle portion 37 of wrench 21 shown in FIG. 3. Third handle portion 37 also has a defined cross-sectional thickness D3 shown at this cross-sectional cut view.

Referring to FIGS. 6, 7 and 8 together, the third handle portion 37 has a cross-sectional thickness D3 substantially greater than the cross-sectional thickness D1 of the first handle portion 33, and also the cross-sectional thickness D2 of the second handle portion 35. Likewise, it is also easy to see and comprehend that third handle portion 37 has a defined cross-sectional area substantially greater than the defined cross-sectional area of each of the first and second handle portions 33 and 35 respectively. Again, applicant defines "cross-sectional" herein as relating to a cut section of a handle portion with the cut being substantially perpendicular to an imaginary longitudinal axis. Applicant defines "thickness" herein, as being the smallest dimension measurable across and through the center of the cut section of a handle portion. And, applicant defines "area" herein, as the measure, in square units, of a surface, for example, the cut section of a handle portion. All embodiments of the present invention wrench include an elongated handle with a strengthened midsection or third handle portion, which has at least one location at which the defined cross-sectional thickness and/or defined cross-sectional area is substantially greater than a cross-sectional thickness and/or cross-sectional area of each of the outer handle portions (first and second handle portions). The cross-sectional thickness and/or cross-sectional area of each handle portion may vary along the same handle portion, however, each handle portion must have at least one location at which the above structural relationships occur. The defined structure of the present invention shown in FIGS. 3, 4, 5, 6, 7, and 8 provide substantial and significant structural advantages over typical prior art, double-ended wrenches. The improvements include additional wrench strength and durability, additional user control, comfort and torque capabilities, and a reduction in user fatigue and possible tool related injuries.

Figure 9:
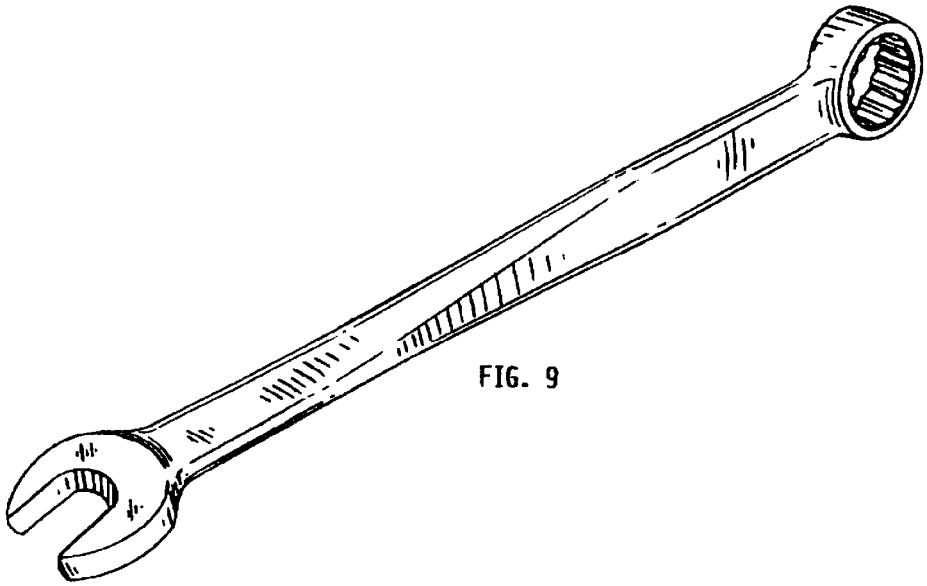

FIG. 9 shows a perspective view of another present invention double-ended wrench.

Figure 10:
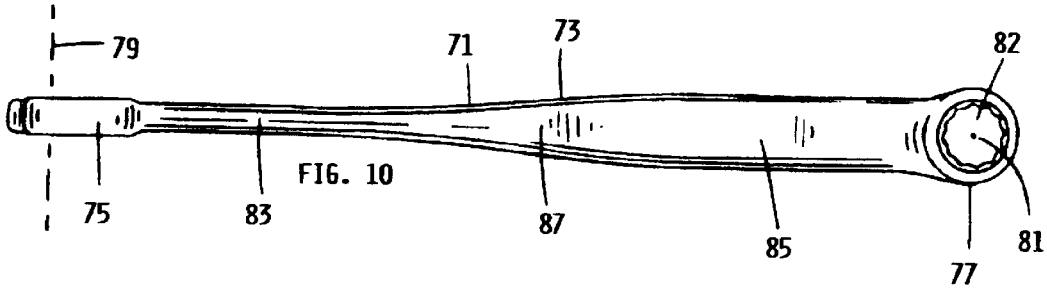
Figure 11:
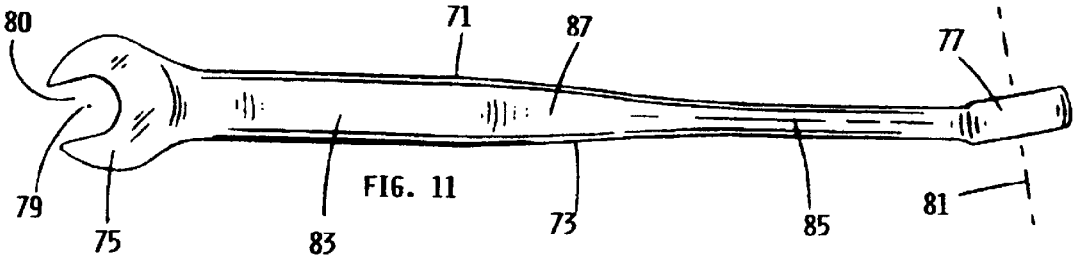

Referring to FIGS. 10 and 11 together, there is shown a present invention double-ended wrench shown in a left side elevational view and a top plan view respectively. Double-ended wrench 71 is shown comprising a first wrench head 75 connected to one end of an elongated handle 73 and a second wrench head 77 connected to the other end thereof. Wrench head 75 has an orifice 80, and wrench head 77 has orifice 82. Each orifice is formed for engagement with various fasteners. Orifice 80 has an imaginary central axis of wrench rotation 79, and orifice 82 has an imaginary central axis of wrench rotation 81. The first wrench head 75 is positioned relative to the second wrench head 77 whereas the axis of wrench rotation 79 of the first wrench head 75 is substantially perpendicular to the axis of wrench rotation 81 of the second wrench head 77. The elongated handle 73 is formed comprising a first handle portion 83 connecting to the first wrench head 75, and a second handle portion 85 connecting to the second wrench head 77, and a third handle portion 87 located between the first and second handle portions. The wrench heads 75 and 77 are each fixedly connected to wrench 71. Preferred embodiments of the present invention may have one or both wrench heads fixedly connected to the elongated handle of the wrench. Other embodiments may have one or both wrench heads pivotably connected to the elongated handle of the wrench to enhance wrench-to-fastener accessibility. When operating wrench 71, a user will generally grip handle portion 85 to turn wrench head 75 about imaginary central axis 79 to turn various fasteners. It can be seen in FIG. 10 that handle portion 85 provides a surface area substantially greater than that of the prior art wrench shown in FIG. 1, for the application of force by a user to turn wrench head 75 about axis of wrench rotation 79. Alternatively, a user will generally grip handle portion 83 to turn wrench head 77 about imaginary central axis 81 to turn various fasteners. It can be seen in FIG. 11 that handle portion 83 provides a surface area substantially greater than that of prior art wrench shown in FIG. 1, for the application of force by a user to turn wrench head 77 about axis of wrench rotation 81. The present invention, double-ended wrench may have two wrench heads which are the same type, or, two wrench heads which are different in type. Each wrench head may be fixed or pivotably connected to a handle portion of the wrench. Other embodiments of the present invention may include a ratcheting mechanism contained in one or both wrench heads to expedite the wrenching process.

When considering the present invention, simplicity and obviousness should not be confused or considered the same. Accordingly, the novelty and complexity of the present invention must be measured by the many interrelated objectives set forth herein, including accessibility, comfort, torque, strength, durability and ergonomic considerations.

Upon reading and understanding the specification of the present invention described above, modifications and alterations will become apparent to those skilled in the art. It is intended that all such modifications and alterations be included insofar as they come within the scope of the patent as claimed or the equivalence thereof.

Having thus described the invention, the following is claimed:

1. A double-ended wrench comprising a first wrench head fixedly connected to one end of a nondetachable elongated handle and a second wrench head fixedly connected to the other end thereof, each said wrench head having an orifice formed for engagement with various fasteners, each said orifice having an imaginary central axis of wrench rotation, said first wrench head being positioned relative to said second wrench head whereas the axis of wrench rotation of said first wrench head is substantially perpendicular to the axis of wrench rotation of said second wrench head, said nondetachable elongated handle being formed comprising a first handle portion connecting to said first wrench head, and a second handle portion connecting to said second wrench head, and a third handle portion located between said first and second handle portions, each said handle portion having a location at which there is a defined cross-sectional thickness when said wrench is viewed from an end view thereof, and, said third handle portion having a cross-sectional thickness substantially greater than a cross-sectional thickness of each of said first and second handle portions.

2. A double-ended wrench of claim 1, wherein said first wrench head is a different type of wrench head than said second wrench head.

3. A double-ended wrench of claim 1, wherein both of said wrench heads are the same type of wrench head.

4. A double-ended wrench of claim 1, wherein at least one of said wrench heads includes a ratcheting mechanism.

5. A double-ended wrench comprising a first wrench head fixedly connected to one end of a nondetachable elongated handle and a second wrench head fixedly connected to the other end thereof, each said wrench head having an orifice formed for engagement with various fasteners, each said orifice having an imaginary central axis of wrench rotation, said first wrench head being positioned relative to said second wrench head whereas the axis of wrench rotation of said first wrench head is substantially perpendicular to the axis of wrench rotation of said second wrench head, said nondetachable elongated handle being formed comprising a first handle portion connecting to said first wrench head, and a second handle portion connecting to said second wrench head, and a third handle portion located between said first and second handle portions, each said handle portion having a location at which there is a defined cross-sectional area when said wrench is viewed from an end view thereof, and, said third handle portion having a cross-sectional area substantially greater than a cross-sectional area of each of said first and second handle portions.

6. A double-ended wrench of claim 5, wherein said first wrench head is a different type of wrench head than said second wrench head.

7. A double-ended wrench of claim 5, wherein both of said wrench heads are the same type of wrench head.

8. A double-ended wrench of claim 5, wherein at least one of said wrench heads includes a ratcheting mechanism.

9. A double-ended wrench comprising a first wrench head positioned at one end of said wrench and a second wrench head positioned at the other end thereof and a nondetachable elongated handle between said wrench heads extending in a longitudinal direction; each said wrench head having an orifice with an imaginary axis of wrench rotation, said first wrench head being positioned relative to said second wrench head whereas the axis of wrench rotation of said first wrench head is substantially perpendicular to the axis of wrench rotation of said second wrench head, said nondetachable elongated handle comprising a first handle portion connecting to said first wrench head, and a second handle portion connecting to said second wrench head, and a third handle portion located between said first and second handle portions, each said handle portion having a cross-sectional shape when viewed in a cross-sectional plane perpendicular to said longitudinal direction, the cross-sectional shape of said first handle portion being elongated in a direction substantially perpendicular to the axis of wrench rotation of said first wrench head and substantially parallel to the axis of wrench rotation of said second wrench head, and, the cross-sectional shape of said second handle portion being elongated in a direction substantially perpendicular to the axis of wrench rotation of said second wrench head and substantially parallel to the axis of wrench rotation of said first wrench head, and, each said handle portion having a location at which there is a defined cross-sectional thickness when said wrench is viewed from an end view thereof, and, the third handle portion having a cross-sectional thickness substantially greater than a cross-sectional thickness of each of said first and second handle portions.

10. A double-ended wrench of claim 9, wherein said first wrench head is a different type of wrench head than said second wrench head.

11. A double-ended wrench of claim 9, wherein both of said wrench heads are the same type of wrench head.

12. A double-ended wrench of claim 9, wherein at least one of said wrench heads includes a ratcheting mechanism.

13. A double-ended wrench comprising a first wrench head positioned at one end of said wrench and a second wrench head positioned at the other end thereof and a nondetachable elongated handle between said wrench heads extending in a longitudinal direction; each said wrench head having an orifice with an imaginary axis of wrench rotation, said first wrench head being positioned relative to said second wrench head whereas the axis of wrench rotation of said first wrench head is substantially perpendicular to the axis of wrench rotation of said second wrench head, said nondetachable elongated handle comprising a first handle portion connecting to said first wrench head, and a second handle portion connecting to said second wrench head, and a third handle portion located between said first and second handle portions, each said handle portion having a cross-sectional shape when viewed in a cross-sectional plane perpendicular to said longitudinal direction, the cross-sectional shape of said first handle portion being elongated in a direction substantially perpendicular to the axis of wrench rotation of said first wrench head and substantially parallel to the axis of wrench rotation of said second wrench head, and, the cross-sectional shape of said second handle portion being elongated in a direction substantially perpendicular to the axis of wrench rotation of said second wrench head and substantially parallel to the axis of wrench rotation of said first wrench head, and, each said handle portion having a location at which there is a defined cross-sectional area when said wrench is viewed from an end view thereof, and, the third handle portion having a cross-sectional area substantially greater than a cross-sectional area of each of said first and second handle portions.

14. A double-ended wrench of claim 13, wherein said first wrench head is a different type of wrench head than said second wrench head.

15. A double-ended wrench of claim 13, wherein both of said wrench heads are the same type of wrench head.

16. A double-ended wrench of claim 13, wherein at least one of said wrench heads includes a ratcheting mechanism.

17. A double-ended wrench comprising a first wrench head positioned at one end of said wrench and a second wrench head positioned at the other end thereof and an elongated handle formed substantially nontwisted between said wrench heads extending in a longitudinal direction; each said wrench head having an orifice with an imaginary axis of wrench rotation, said first wrench head being positioned relative to said second wrench head whereas the axis of wrench rotation of said first wrench head is substantially perpendicular to the axis of wrench rotation of said second wrench head, said elongated handle comprising a first handle portion connecting to said first wrench head, and a second handle portion connecting to said second wrench head, and a third handle portion located between said first and second handle portions, each said handle portion having a cross-sectional shape when viewed in a cross-sectional plane perpendicular to said longitudinal direction, the cross-sectional shape of said first handle portion being elongated in a direction substantially perpendicular to the axis of wrench rotation of said first wrench head and substantially parallel to the axis of wrench rotation of said second wrench head, and, the cross-sectional shape of said second handle portion being elongated in a direction substantially perpendicular to the axis of wrench rotation of said second wrench head and substantially parallel to the axis of wrench rotation of said first wrench head, and, each said handle portion having a location at which there is a defined cross-sectional thickness when said wrench is viewed from an end view thereof, and, the third handle portion having a cross-sectional thickness substantially greater than a cross-sectional thickness of each of said first and second handle portions.

18. A double-ended wrench of claim 17, wherein said first wrench head is a different type of wrench head than said second wrench head.

19. A double-ended wrench of claim 17, wherein both of said wrench heads are the same type of wrench head.

20. A double-ended wrench of claim 17, wherein at least one of said wrench heads includes a ratcheting mechanism.

21. A double-ended wrench of claim 17, wherein at least one of said wrench heads is pivotably connected to a handle portion.

22. A double-ended wrench comprising a first wrench head positioned at one end of said wrench and a second wrench head positioned at the other end thereof and an elongated handle formed substantially nontwisted between said wrench heads extending in a longitudinal direction; each said wrench head having an orifice with an imaginary axis of wrench rotation, said first wrench head being positioned relative to said second wrench head whereas the axis of wrench rotation of said first wrench head is substantially perpendicular to the axis of wrench rotation of said second wrench head, said elongated handle comprising a first handle portion connecting to said first wrench head, and a second handle portion connecting to said second wrench head, and a third handle portion located between said first and second handle portions, each said handle portion having a cross-sectional shape when viewed in a cross-sectional plane perpendicular to said longitudinal direction, the cross-sectional shape of said first handle portion being elongated in a direction substantially perpendicular to the axis of wrench rotation of said first wrench head and substantially parallel to the axis of wrench rotation of said second wrench head, and, the cross-sectional shape of said second handle portion being elongated in a direction substantially perpendicular to the axis of wrench rotation of said second wrench head and substantially parallel to the axis of wrench rotation of said first wrench head, and, each said handle portion having a location at which there is a defined cross-sectional area when said wrench is viewed from an end view thereof, and, the third handle portion having a cross-sectional area substantially greater than a cross-sectional area of each of said first and second handle portions.

23. A double-ended wrench of claim 22, wherein said first wrench head is a different type of wrench head than said second wrench head.

24. A double-ended wrench of claim 22, wherein both of said wrench heads are the same type of wrench head.

25. A double-ended wrench of claim 22, wherein at least one of said wrench heads includes a ratcheting mechanism.

26. A double-ended wrench of claim 22, wherein at least one of said wrench heads is pivotably connected to a handle portion.

* * * * *